United States Patent [19]

Hinata et al.

[11] 4,138,266

[45] Feb. 6, 1979

[54] METHOD FOR SPECTRALLY SENSITIZING PHOTOGRAPHIC LIGHT-SENSITIVE EMULSIONS

[75] Inventors: Masanao Hinata; Yuji Mihara; Tadao Shishido; Keiichi Adachi, all of Minami-ashigara, Japan

[73] Assignee: Fuji Photo Film Co., Ltd., Minami-ashigara, Japan

[21] Appl. No.: 765,314

[22] Filed: Feb. 3, 1977

Related U.S. Application Data

[63] Continuation-in-part of Ser. No. 644,004, Dec. 24, 1975, abandoned.

[30] Foreign Application Priority Data

Dec. 24, 1974 [JP] Japan ..... 49-946

[51] Int. Cl.[2] ..... G03G 5/09; G03C 1/10; G03C 1/114; G03C 1/02

[52] U.S. Cl. ..... 96/123; 96/1.6; 96/1.7; 96/88; 96/120; 96/126; 96/133; 96/137

[58] Field of Search ..... 96/123, 126, 120, 132, 96/137, 139, 122, 128, 127, 1.6, 1.7, 88, 89, 114.5, 92, 93

[56] References Cited

U.S. PATENT DOCUMENTS

| | | | |
|---|---|---|---|
| 2,933,390 | 4/1960 | McFall et al. | 96/126 |
| 2,937,089 | 5/1960 | Jones et al. | 96/126 |
| 2,945,762 | 7/1960 | Carroll et al. | 96/126 |
| 3,615,641 | 10/1971 | Shiba et al. | 96/122 |
| 3,822,135 | 7/1974 | Sakai et al. | 96/120 |
| 3,873,324 | 3/1975 | Hinata et al. | 96/124 |

*Primary Examiner*—Richard L. Schilling
*Attorney, Agent, or Firm*—Sughrue, Rothwell, Mion, Zinn and Macpeak

[57] ABSTRACT

A method of spectrally sensitizing a photographic light-sensitive emulsion where a water-soluble solution, prepared by dissolving a methine dye having at least one water-soluble group in water in the presence of a "Red Shift Compound", as hereinafter defined, is added to a photographic light-sensitive emulsion to provide a photographic light-sensitive emulsion spectrally sensitized with increased sensitizing efficiency and with reduced fog. The disadvantages caused by the use of high organic solvent contents are avoided and photographic light-sensitive emulsions suitable for high-speed coating are obtained.

12 Claims, 1 Drawing Figure

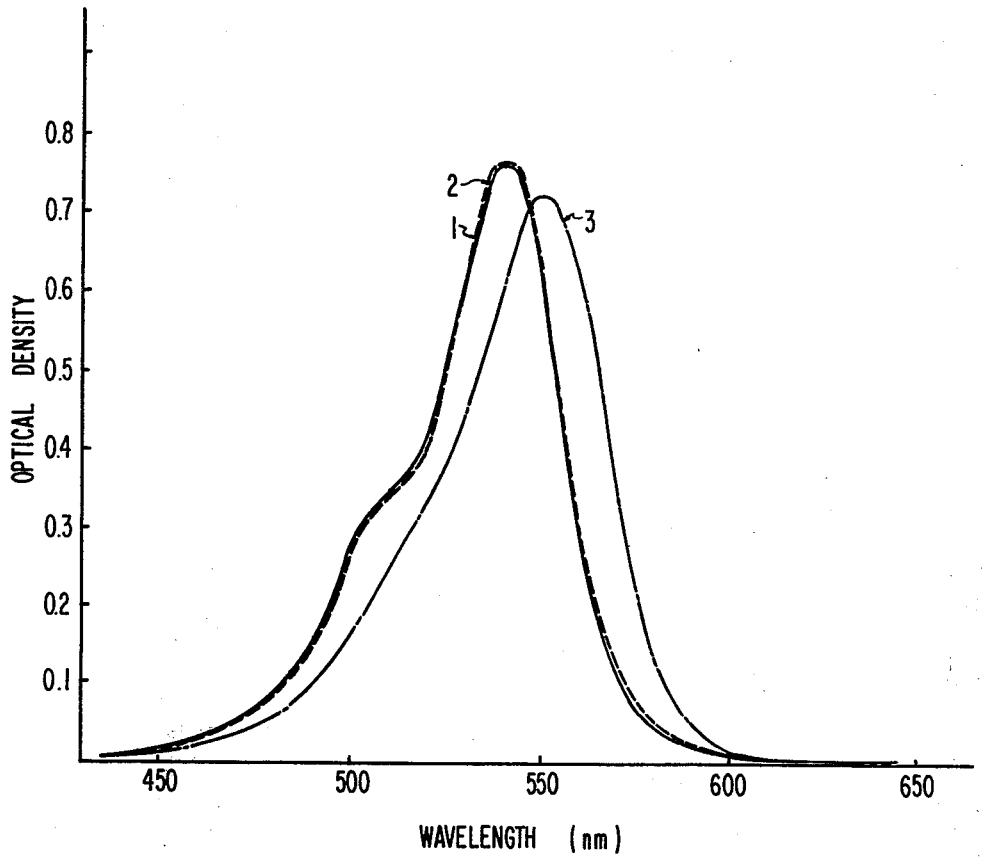
0.8
0.7
0.6
0.5
0.4
0.3
0.2
0.1
OPTICAL DENSITY
2
1
3
450
500
550
600
650
WAVELENGTH (nm)

METHOD FOR SPECTRALLY SENSITIZING PHOTOGRAPHIC LIGHT-SENSITIVE EMULSIONS

CROSS-REFERENCE TO RELATED APPLICATIONS

This application is a continuation-in-part application of co-pending application, Ser. No. 644,004, filed Dec. 24, 1975.

BACKGROUND OF THE INVENTION

1. Field of the Invention

The present invention relates to an improvement in spectral sensitizing methods for photographic light-sensitive emulsions, more particularly, it is concerned with a method of spectrally sensitizing photographic light-sensitive emulsions wherein effective spectral sensitization is achieved by improving the method of adding sensitizing dyes to the emulsions.

2. Description of the Prior Art

In the art of manufacturing photographic light-sensitive materials, it is well known that spectral sensitizing techniques (i.e., techniques for extending the spectral sensitization distribution of a light-sensitive material so as to range over the visible wavelength region) play an important roll, and they are essential for color photographic materials. Generally speaking, the process of spectrally sensitizing a photographic light-sensitive emulsion consists of dyeing light-sensitive materials dispersed therein, e.g., inorganic light-sensitive elements such as crystals of silver halide, zinc oxide, cadmium sulfide, titanium oxide or the like, and organic light-sensitive elements such as organic silver complexes, organic macromolecular photo-conductors or the like, by the addition of spectral sensitizing dyes suitable for each light-sensitive material. In particular, many methods have been introduced to the art for spectrally sensitizing silver halide photographic emulsions. The state of adsorption of a spectral sensitizing dye on the surfaces of silver halide crystals in an emulsion is influenced by the conditions of adding the dye, which has substantial effects on photographic characteristics such as fog, sensitivity, spectral sensitization distribution, desensitization, the stability of the sensitization, etc., as is described in detail in *The Theory of the Photographic Process* by C. E. K. Mees, 2nd Edition, Chapter 12, pages 430–500, Macmillan Publishers, 1954.

The most important condition which is required to provide a stable spectral sensitization action on light-sensitive crystals with the high sensitivity thereof retained is to achieve a state where each of the spectral sensitizing dye molecules which is added to an emulsion arrives at one of the adsorption sites of a light-sensitive crystal in a stable manner, to result in the adsorption thereof by interaction with a binder incorporated in the emulsion, and without aggregating or separating out of the binder. Moreover, another important condition is that the light-sensitive crystals dispersed in the light-sensitive emulsion should each homogeneously adsorb the same quantity of spectral sensitizing dye molecules.

A wide variety of methods for adding spectral sensitizing dyes to light-sensitive photographic emulsions are known. As disclosed in Japanese Patent Publication 22948/69, a solution prepared by dissolving a spectral sensitizing dye in a volatile, slightly water-soluble organic solvent is mixed with a hydrophilic colloid, followed by heating the mixture to remove the solvent therefrom to result in the formation of a dispersion. In this method, some spectral sensitizing dyes decompose during the heating which is necessary to remove the volatile organic solvent. In addition, this method has an economic disadvantage of requiring heating.

Moreover, there is another method wherein substantially water-insoluble spectral sensitizing dyes are dispersed in a water-soluble organic solvent without being dissolved therein. This method has the economic disadvantage that a long time is required to disperse such dyes using a colloid mill or the like.

In another commonly used method, a solution prepared by dissolving a dye in a water-miscible organic solvent (e.g., acetone, methanol, ethanol, propanol, methyl Cellosolve, pyridine, etc.) is added to an emulsion. Water may be added in part to these organic solvents, if desired. In such a method, high-speed coating (e.g., a coating speed of more than 100 meters per minute) is difficult, particularly when the solubility of the spectral sensitizing dye in the organic solvent is low, as the high amounts of organic solvent employed therein lower the surface active ability of coating aids therein, flocculate the binder and further solidify couplers present in the case of color light-sensitive materials. Often only a weak spectral sensitization can be obtained with such a method, because binder molecules are adsorbed by the spectral sensitizing dye molecules in preference to the silver halide crystals, or because the spectral sensitizing dye molecules themselves aggregate when the dye-containing solution is added to the emulsion as the organic solvent employed to dissolve the dye immediately mixes with water.

In addition to the above, a water solution of a spectral sensitizing dye as disclosed in Japanese Patent Publication 27555/69, dissolving a spectral sensitizing dye in a water solution of an anionic surface active agent as disclosed in U.S. Pat. No. 3,822,135 or using an acidic aqueous solution (made acidic by adding a strong acid to a spectral sensitizing dye-containing water solution) as disclosed in Japanese Patent Publication 23389/69 are known.

In the case of dissolving a dye in an acidic solution using a strong acid as disclosed in Japanese Patent Publication 23389/69, the resulting emulsion does become stable to light-exposure, but a number of dyes are hard to dissolve in an acidic aqueous solution, and even if certain dyes can be dissolved therein they may decompose upon storage of the solutions of the dyes. Further, even in the case of acidic aqueous solutions ranging in pH from pH 6.0 to pH 7.5 as disclosed in Japanese Patent Publication 27555/69, many dyes are hard to dissolve in aqueous solutions having such pH values, and many dissolvable dyes decompose because of poor storage capability with the passage of time. Therefore, a number of dyes cannot be employed therein.

Further, the method of solubilizing dyes in an aqueous solution containing an anionic surface active agent beyond the CMC concentration is useful for dissolving dyes slightly soluble in water, as disclosed in U.S. Pat. No. 3,822,135. However, there are many dyes which cannot be solubilized by such an anionic surface active agent-containing aqueous solution, so there are many cases in which water solutions of dyes cannot be formed.

SUMMARY OF THE INVENTION

It is, therefore, one object of the present invention to provide an improved method for spectrally sensitizing a photographic light-sensitive emulsion.

Another object of the present invention is to provide a spectral sensitizing method for a photographic light-sensitive emulsion wherein the efficiency of the spectral sensitization is enhanced.

A further object of the present invention is to provide a spectral sensitizing method for a photographic light-sensitive emulsion which reduces fog in the spectrally sensitized photographic light-sensitive emulsion.

Still another object of the present invention is to provide a spectral sensitizing method for a photographic light-sensitive emulsion wherein disadvantages caused by an organic solvent which is incorporated in the photographic light-sensitive emulsion in high concentrations are avoided.

Still a further object of the present invention is to provide a spectral sensitizing method for a photographic light-sensitive emulsion wherein a photographic light-sensitive emulsion suitable for high-speed coating is obtained.

The above-described objects are attained by adding an aqueous solution of a methine dye having a water-soluble group, prepared by dissolving the dye in water in the presence of one or more "Red Shift Compounds" as hereinafter defined, which is used to render the dye water-soluble, to a photographic light-sensitive emulsion.

BRIEF DESCRIPTION OF THE DRAWING

The drawing shows the spectral absorption curves of various dye solutions. Curve 1 shows the spectral absorption curve of an aqueous solution of Dye 3, curve 2 shows the spectral absorption curve of an aqueous solution of a mixture of Dye 3 and Compound A, and curve 3 shows the spectral absorption curve of an aqueous solution of a mixture of Dye 3 and Compound 20.

DETAILED DESCRIPTION OF THE INVENTION

The term "Red Shift Compounds" as is used in the present specification and claims means compounds which, when added to a water-soluble group-containing methine dye in a water-alcohol mixture (volume ratio of water to alcohol: 4:1), cause the maximum absorption wavelength of the dye to shift to a longer wavelength, preferably at least about 1 mμ longer, most preferably at least 2 mμ longer.

Useful compounds employed as "Red Shift Compounds" in the present invention are represented by the following general formula (I):

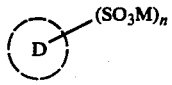

(I)

wherein M represents a hydrogen atom or a cation capable of rendering the compound water-soluble, n represents a positive integer, preferably an integer of from 1 to 10, and D represents one of the residues described below:

(1) a polycyclic aromatic hydrocarbon residue;
(2) a polycyclic heteroring residue; and
(3) a polycyclic residue formed by directly combining at least two rings, and preferably no more than 10 rings, selected from the group consisting of monocyclic aromatic hydrocarbon rings, polycyclic aromatic hydrocarbon residues as above, monocyclic heterocyclic rings and polycyclic heteroring residues as above, or by combining the above-mentioned at least two rings through an atom or an atomic group, e.g., sulfur, a methine group, an imino group, etc.

As specific examples of the above polycyclic aromatic hydrocarbon residues (1), mention can be made of naphthalene and anthracene; as specific examples of the above polycyclic heteroring residues (2), mention can be made of β-naphthotriazole and dibenzothiophene-5,5-dioxide; and as specific examples of the above polycyclic residues (3), mention can be made of those of the formulae:

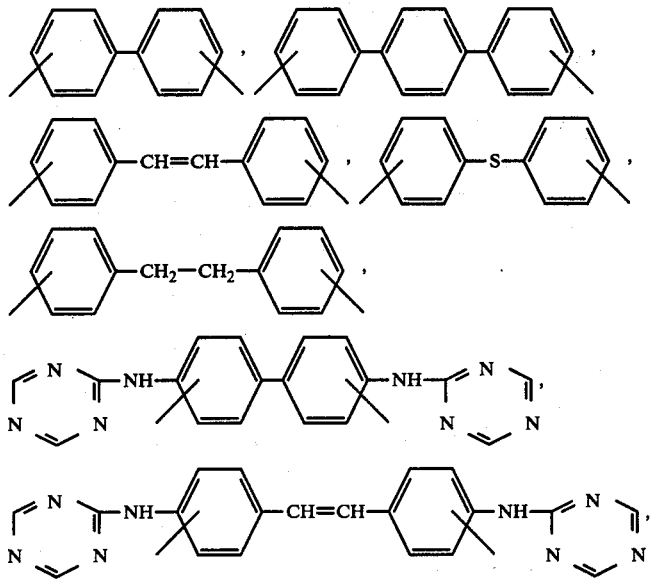

-continued

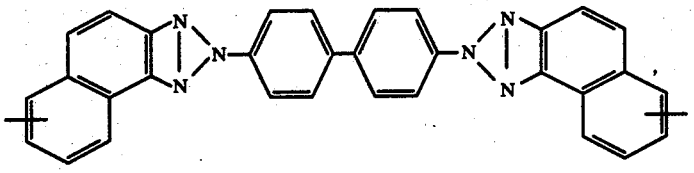

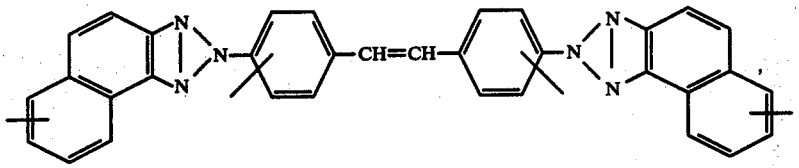

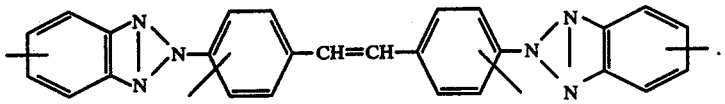

Of the compounds represented by general formula (I), preferred ones are those which contain in each molecule not less than four benzene rings, and preferably no more than 10 benzen rings, including the benzene rings in any condensed polycyclic heteroring residues therein, and more preferred are those which additionally contain not less than four sulfo groups in each molecule, and preferably less than 10 sulfo groups in each molecule.

An especially useful class of "Red Shift Compounds" are those within general formula (I) represented by general formula (II):

$$D_1—A—D_2 \qquad (II)$$

wherein $D_1$ and $D_2$ each represents a polycyclic heteroring residue containing one or more aromatic rings, preferably 1 or 2 aromatic rings, (e.g., 2-benzotriazolyl group, 2-naphthotriazolyl group, etc.), or a mono- or di-substituted amino group condensed with the heterocyclic ring residue(s), preferably nitrogen-containing heterocyclic ring(s), (e.g., triazine and pyrimidines such as 1,3,5-triazine-2-yl amino group, pyrimidine-2-yl amino groups, etc.), and A represents a divalent aromatic residue, preferably comprising 1 to 4 aromatic rings, wherein at least one of $D_1$, $D_2$ and A is substituted with at least one sulfo group (—$SO_3M$), preferably no more than 10 sulfo groups, wherein M has the same meaning as in the general formula (I).

Specific examples of divalent aromatic residues represented by A are as follows:

Sulfo group-containing divalent aromatic residues:

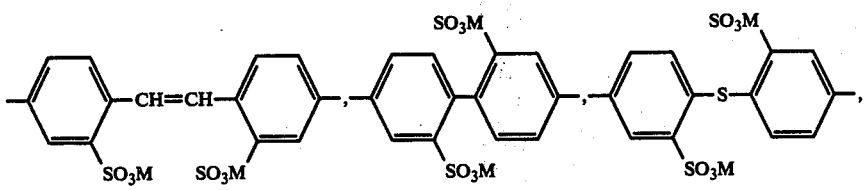

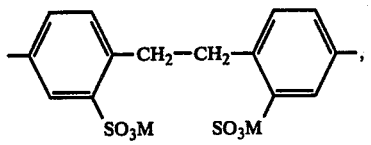

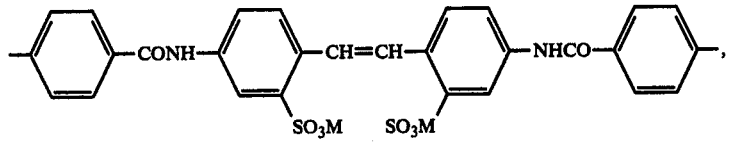

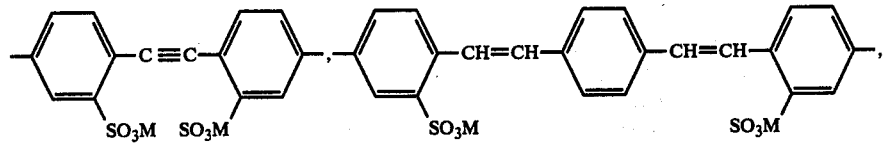

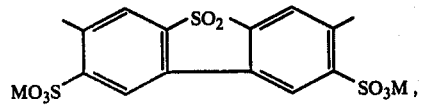

-continued

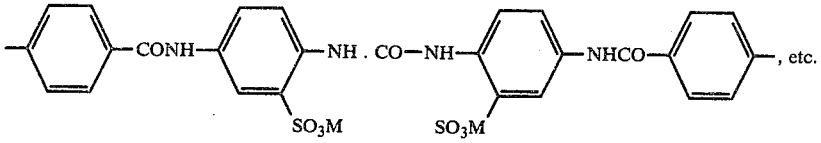

Divalent aromatic residues free of sulfo groups:

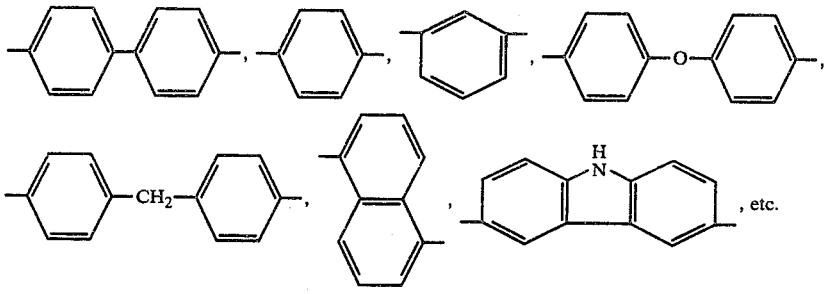

In the latter case, i.e., where A does not contain a sulfo group, at least either $D_1$ or $D_2$ should have a substituent comprising an $SO_3M$ group.

Another useful class of "Red Shift Compounds" within general formula (I) are those represented by general formula (III):

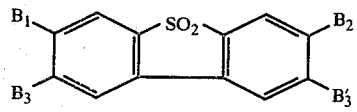

(III)

wherein $B_1$ and $B_2$ each represents an acylamino group (e.g., acetamide, sulfobenzamide, 4-methoxy-3-sulfobenzamide, 2-ethoxybenzamide, 2,4-diethoxybenzamide, p-tolylamide, 4-methyl-2-methoxybenzamide, 1-naphthoylamino, 2-naphthoylamino, 2,4-dimethoxybenzamide, 2-phenylbenzamide, 2-thienylbenzamide, etc.), a sulfo group (which may be in the form of an alkali metal salt, e.g., a sodium or potassium salt, or an ammonium salt) or a sulfoaryl group (e.g., p-sulfophenyl, p-sulfobiphenyl, etc.), where $B_1$ may be the same as or different from $B_2$, and $B_3$ and $B_3'$ each represents a hydrogen atom or a sulfo group (which may be in the form of an alkali metal salt, e.g., a sodium or potassium salt, or an ammonium salt), where at least one of $B_1$, $B_2$, $B_3$ and $B_3'$ is a sulfo group (or a salt of a sulfo group).

Especially preferred classes of the compounds within general formula (II) are represented by the following general formula (IV) or (V):

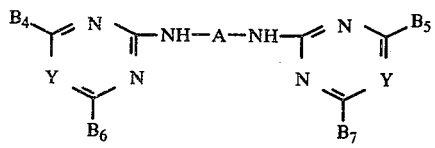

(IV)

wherein —A— has the same meaning as in Formula (II), Y represents =CH—, =$CB_8$— or =N—, wherein $B_8$ represents an alkyl group, preferably having from 1 to 4 carbon atoms, or a halogen atom, and $B_4$, $B_5$, $B_6$ and $B_7$ each represents a hydrogen atom, a hydroxy group, an alkoxy group, preferably having from 1 to 10 carbon atoms, an alkyl group (preferably having from 1 to 10 carbon atoms, e.g., methyl, ethyl, etc.), an aryloxy group (e.g., phenoxy, o-tolyloxy, p-sulfophenoxy, etc.), a halogen atom (e.g., chlorine, bromine, etc.), a heterocyclic nucleus (e.g., morpholinyl, piperidyl, etc.), an alkylthio group (wherein the alkyl moiety preferably has from 1 to 10 carbon atoms, e.g., methylthio, ethylthio, etc.), a heterocyclothio group (e.g., benzothiazolylthio, etc.), an arylthio group (e.g., phenylthio, tolylthio, etc.), an amino group, an alkylamino group, which term includes an unsubstituted and a substituted alkylamino group such as a hydroxy or sulfo-substituted alkylamino group (preferably an alkylamino group or substituted alkylamino group wherein the alkyl moiety has from 1 to 10 carbon atoms, e.g., methylamino, ethylamino, propylamino, dimethylamino, diethylamino, dodecylamino, cyclohexylamino, β-hydroxyethylamino, di-(β-hydroxyethyl)amino, β-sulfoethylamino, etc.), an arylamino group, which term includes an unsubstituted arylamino group and a substituted arylamino group, preferably a substituted arylamino group wherein the substituent is an alkyl group of from about 1 to 4 carbon atoms, a sulfo group, a carboxy group, a hydroxy group, and the like (e.g., anilino, o-sulfoanilino, m-sulfoanilino, p-sulfoanilino, o-anisylamino, m-anisylamino, p-anisylamino, o-toluidino, m-toluidino, p-toluidino, o-carboxyanilino, m-carboxyanilino, p-carboxyanilino, hydroxyanilino, disulfophenylamino, naphthylamino, sulfonaphthylamino, etc.), a heterocycloamino group (e.g., 2-benzothiazolylamino, 2-pyridyl-amino, etc.), an aryl group (e.g., phenyl, etc.), or a mercapto group, where $B_4$, $B_5$, $B_6$ and $B_7$ may each be the same as or different from one another. When —A— does not contain a sulfo group or a salt of a sulfo group, for example, a salt such as an alkali metal salt, e.g., a sodium or potassium salt, or an ammonium salt, at least one of $B_4$, $B_5$, $B_6$ and $B_7$ comprises at least one sulfo group, and preferably no more than 10 sulfo groups (which may form a salt or may be in the free acid form, for example, a salt such as an alkali metal salt, e.g., a sodium or potassium salt, or an ammonium salt).

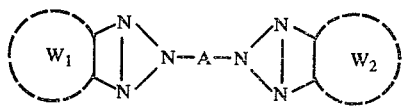

(V)

wherein A has the same meaning as in the general formula (II) and $W_1$ and $W_2$ each represents an atomic group necessary to form a benzene ring or a naphthalene ring, where the benzene ring or naphthalene ring may optionally be substituted by one or more groups including at least one sulfo group, and preferably no more than 10 sulfo groups (wherein the sulfo group(s) may be in the free acid form or in the form of an alkali metal salt, e.g., a sodium salt or a potassium salt, or an ammonium salt), and wherein other representative substituents include alkyl groups having from 1 to 4 carbon atoms, aryl groups (e.g., phenyl, naphthyl) and the like.

Specific examples of "Red Shift Compounds" which can be used in the present invention are illustrated below; the present invention is not limited to the compounds specifically described below, however.

Compound 1

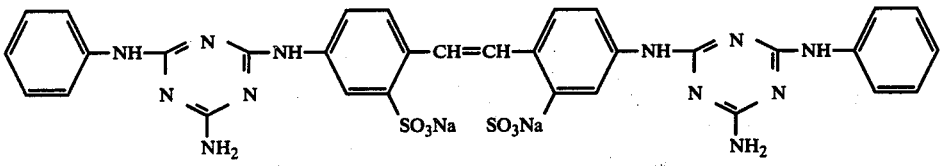

Compound 2

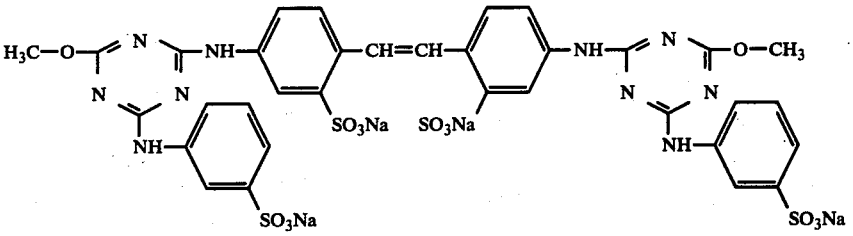

Compound 3

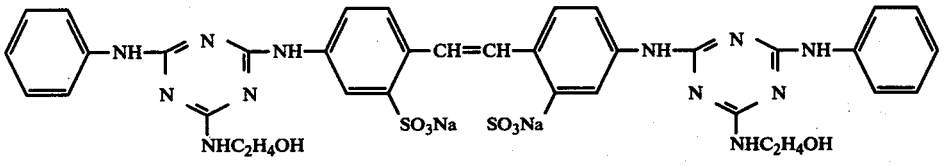

Compound 4

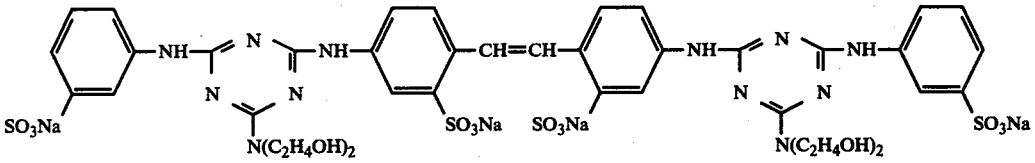

Compound 5

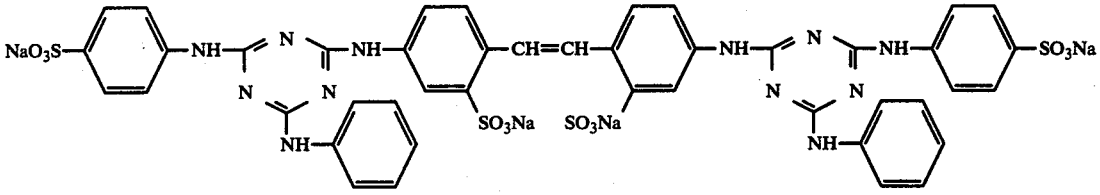

Compound 6

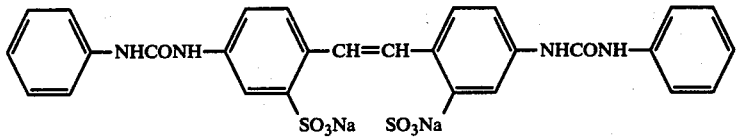

Compound 7

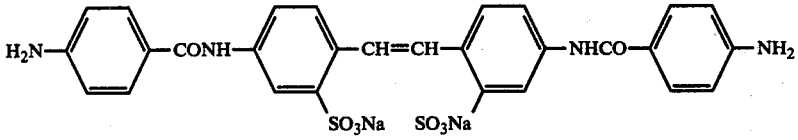

Compound 8

-continued
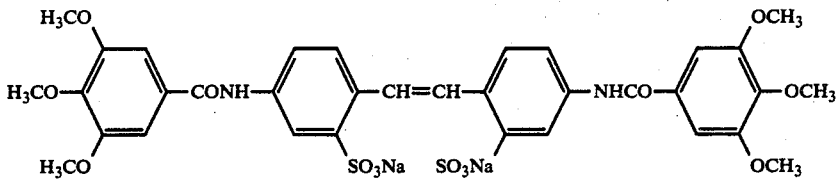
Compound 9
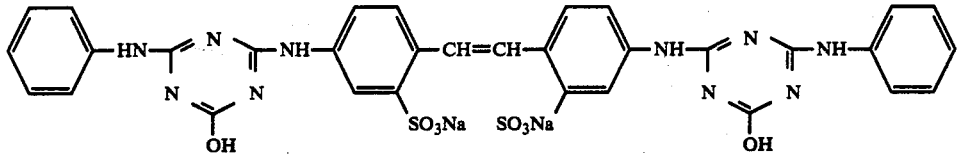
Compound 10
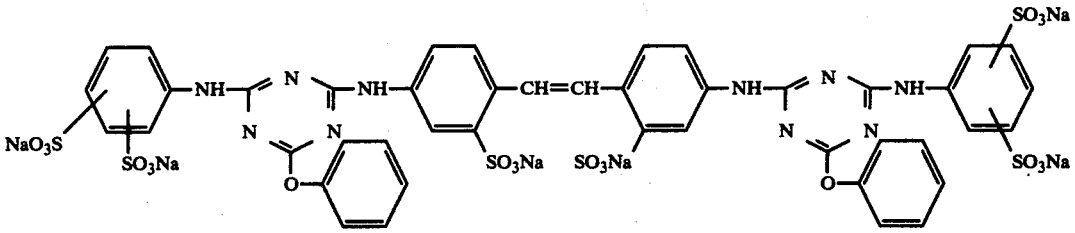
Compound 11
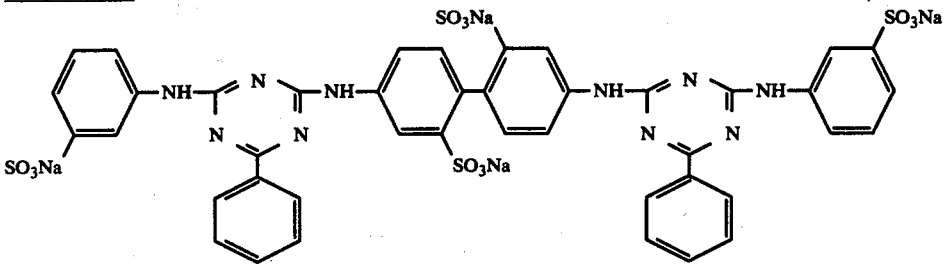
Compound 12
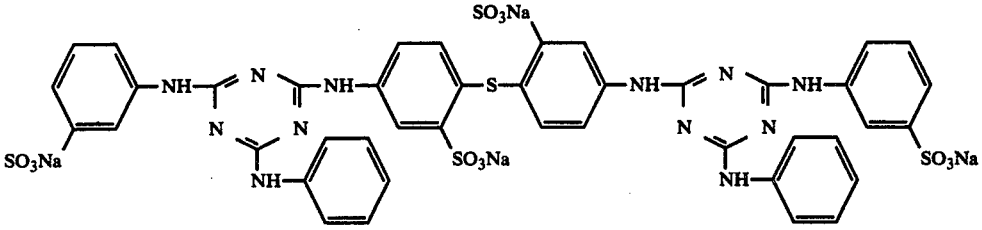
Compound 13
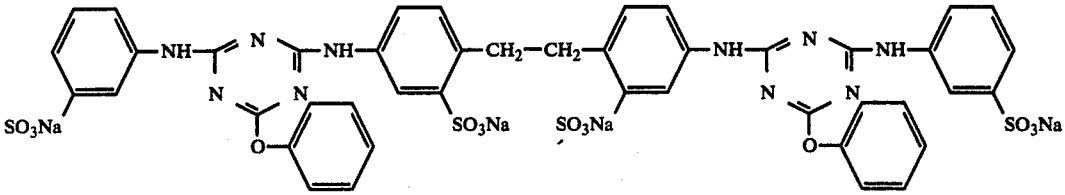
Compound 14
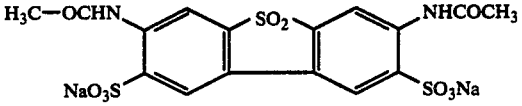
Compound 15

-continued
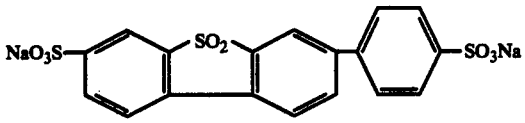
Compound 16
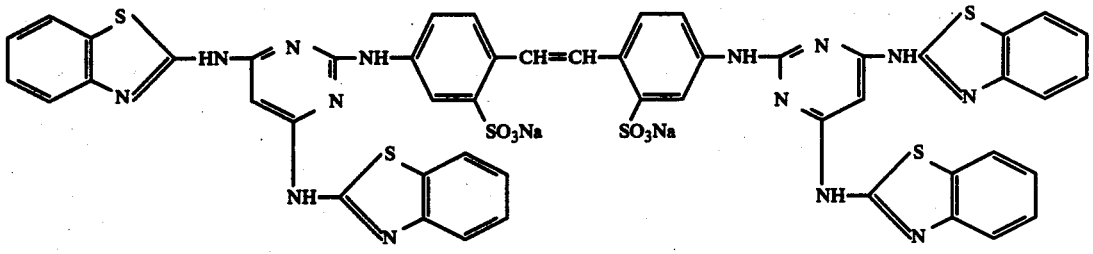
Compound 17
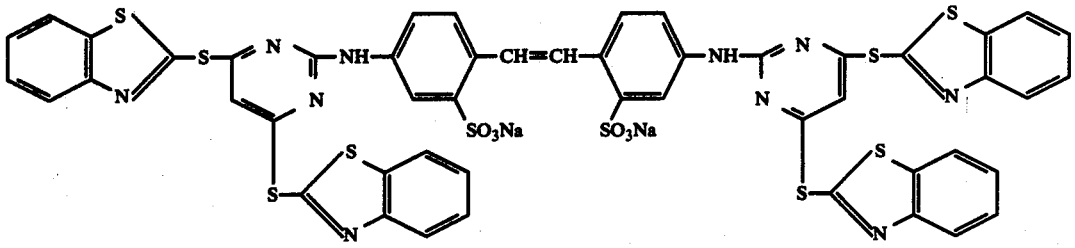
Compound 18
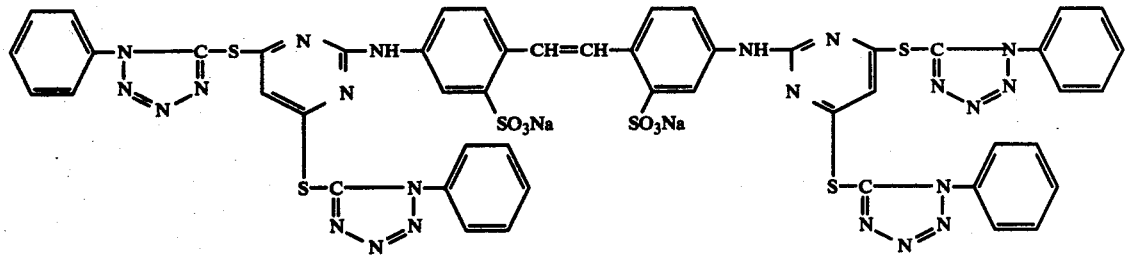
Compound 19
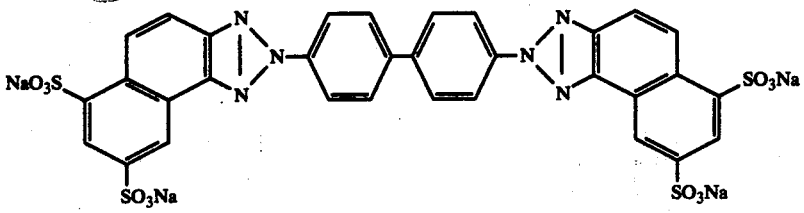
Compound 20
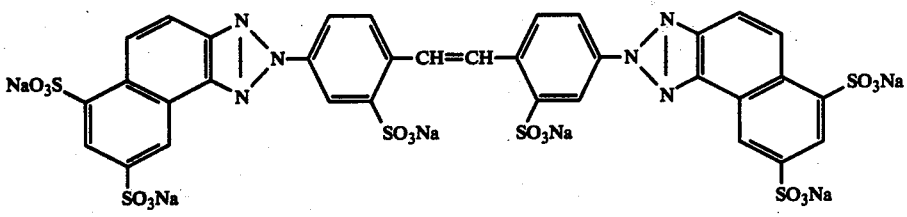
Compound 21
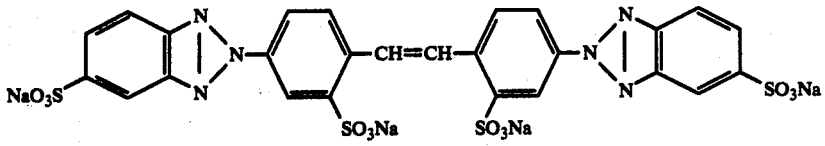
Compound 22

-continued

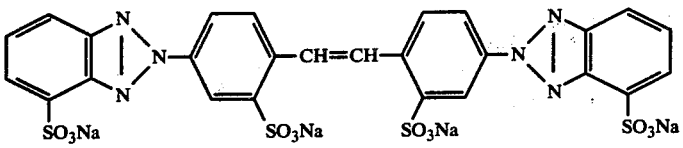

The "Red Shift Compounds" useful in practicing the present invention can be synthesized using known methods. For instance, they can be synthesized by the method described in the specifications of U.S. Pat. Nos. 3,617,295; 3,615,641; 2,937,089; 3,615,632. The "Red Shift Compounds" which can advantageously be employed in practicing the present invention have been described in one or more of the following representative patent references: U.S. Pat. No. 2,933,390; U.S. Pat. No. 2,875,058; U.S. Pat. No. 2,947,630; Japanese Patent Publication 30495/73.

The compounds represented by the general formula (V) useful in practicing the present invention have been described in, for example, Lehrbuch der organishen Chemie, by P. Kasner, 13th ed., p. 520; Color Index, by the Society of Dyers and Colorists, American Association of Textile Chemists and Colorists, vol. 4, 3rd ed., p. 547.

The methine dyes used in the practice of the present invention are characterized by at least one water-soluble group as a substituent group(s) in their molecule. The water-soluble groups with which the methine dyes can be substituted include a sulfo group, a carboxy group, a sulfato group or a phosphato group. In the present invention, a sulfo group in the most useful water-soluble group.

The position(s) of the dye molecule substituted with a water-soluble group or groups is/are not confined to any specified position(s). The water-soluble groups may be introduced directly or through an atomic group, for example, an alkylene group having from 1 to 4 carbon atoms, an arylene group (e.g., phenylene, naphthylene) and the like, at any position(s) of the benzene or the naphthalene nuclei which form a condensed ring in cooperation with a heterocyclic nucleus, or they may be attached directly to the methine chain of the dye. It is preferred for at least one water-soluble group and at least one nitrogen atom in a nitrogen atom-containing heterocyclic nucleus to combine through an aliphatic or an aromatic hydrocarbon chain, for example, an alkyl group having from 1 to 4 carbon atoms or a phenyl group. For example, when a sulfo group is employed as a water-soluble group, it is preferred that a sulfoalkyl group, a sulfoalkenyl group, a sulfoalkoxyalkyl group, a sulfoaryl group or the like be attached to at least one nitrogen atom in a nitrogen atom-containing heterocyclic nucleus.

Useful methine dyes which may be used in the practice of the present invention may be any cyanine dye, merocyanine dye, hemicyanine dye, styryl dye, hemioxonol dye and the like. For numerous examples of such dyes, *The Cyanine Dyes and Related Compounds* by F. M. Hamer, Interscience Publishers should be referred to. These dyes may be employed not only as dyes which spectrally sensitize conventional (negative type) silver halide photographic emulsions but also as desensitizing dyes (which directly act as a sensitizing dye upon positive emulsions.

More specifically, useful methine dyes which may be used in the practice of the present invention include water-soluble group-containing methine dyes as disclosed in Japanese Patent Application (OPI) No. 1630/71: U.S. Pat. Nos. 2,537,880, 3,157,507 and 3,754,673; German Pat. Nos. 1,028,718 and 1,113,873; U.S. Pat. Nos. 2,640,776, 3,157,507, 3,743,517, 3,681,080, 3,656,958, 3,592,657, 3,647,640, 3,617,295, 3,625,698, 3,698,910, 2,519,001, 2,238,231, 2,493,748, 3,793,020, 3,560,214, 3,545,975 and 3,468,883; Japanese Patent Publication 4085/72 (which corresponds to U.S. Pat. No. 3,537,858: German Patent Application (OLS) 2,057,034; British Pat. Nos. 841,119 and 846,298; U.S. Pat. Nos. 3,625,698, 3,480,439, 2,493,748, 2,503,776, 3,196,017, 3,177,210, 2,912,329, 2,945,763, 3,397,060, 3,793,020, 3,672,897, 3,660,103, 3,615,640, 3,644,119, 3,576,641, 3,460,947 and 3,364,031; British Pat. Nos. 742,112 and 840,223; Japanese Patent Publications Nos. 23467/65 and 14112/65; German Pat. Nos. 1,072,765 and 1,177,481; French Pat. Nos. 1,359,683 1,359,761, 1,412,702 and 1,397,876 and so on. These dyes may be used alone or as combinations thereof. For example, the present invention can be applied to supersensitization using combinations of dyes as disclosed in Japanese Patent Publications Nos. 4932/68, 4936/68 and 22884/68 and U.S. Pat. Nos. 3,632,349 and 3,522,052.

Representative cyanine dyes containing at least one water-soluble group which are useful in the practice of the present invention have the following general formula (VI):

$$R-N(-CH=CH)_{m-1}-C=L-(L=L)_{p-1}-C(=CH-CH)_{n-1}=\overset{\oplus}{N}-R_1\ (X^{\ominus})_{q-1} \quad \text{(VI)}$$

wherein m and n each represents 1; p represents 1 or 2; q represents 1 or 2; L represents a methine group (which may be substituted with, for example, an alkyl group (preferably an alkyl group with from 1 to 4 carbon atoms, e.g., methyl, ethyl, etc.), an aryl group (e.g., phenyl, etc., which can be substituted, if desired, with a sulfo group, a carboxy group, a sulfoalkyl group (wherein the alkyl moiety has from 1 to 4 carbon atoms), an alkoxy group of from 1 to 4 carbon atoms, an aryloxy group (e.g., phenoxy) or an aralkyl group (e.g., benzyl)), or the like); Z and $Z_1$ each represents the nonmetallic atoms necessary to complete a 5- or 6-membered nitrogen-containing heterocyclic nucleus, for example, thiazole nuclei (e.g., thiazole, 4-methylthiazole, 4-phenylthiazole, 4,5-dimethylthiazole, 4,5-diphenylthiazole, etc.), benzothiazole nuclei (e.g., benzothiazole, 4-chlorobenzothiazole, 5-chlorobenzothiazole, 6-chlorobenzothiazole, 7-chlorobenzothiazole, 5-nitrobenzothiazole, 6-nitrobenzothiazole, 4-methyl-benzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-chloro-6-nitrobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, 5-phenylbenzothiazole, etc.), naphthothiazole nuclei (e.g., naphtho[2,1-d]thiazole, naphtho[1,2-d]-thiazole, naphtho[2,3-d]thiazole, 5methoxynaphtho[1,2-d]thiazole, 7-ethoxynaphtho[2,1-d]thiazole, 8methoxynaphtho[2,1-d]thiazole, 5-methoxynaptho[2,3-d]thiazole, etc.), thiazoline nuclei (e.g., thiazoline, 4-methylthiazoline, 4-nitrothiazoline, etc.), oxazole nuclei (e.g., oxazole, 4-methyloxazole, 4-nitrooxazole, 5-methyloxazole, 4-phenyloxazole, 4,5-diphenyloxazole, 4-ethyloxazole, etc.), benzoxazole nuclei (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluorobenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole, etc.), naphthoxazole nuclei (e.g., naptho[2,1-d]oxazole, naphtho[1,2-d]-oxazole, naphtho[2,3-d]oxazole, 5-nitronaphtho[2,1-d]oxazole, etc.), oxazoline nuclei (e.g., 4,4-dimethyloxazoline, etc.), selenazole nuclei (e.g., 4-methylselenazole, 4-nitroselenazole, 4-phenylselenazole, etc.), benzoselenazole nuclei (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoseleneazole, etc.), naphthoselenazole nuclei (e.g., naphtho[2,1-d]selenazole, naphtho[1,2-d]selenazole, etc.), 3,3-dialkylindoleinine nuclei (e.g., 3,3-dimethylinodolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3'-dimethyl-5-methylindolenine, 3,3-dimethyl-5-chloroindolenine, etc.), imidazole nuclei (e.g., 1-alkylimidazole, 1-alkyl-4-phenylimidazole, 1-alkylbenzimidazole, 1-alkyl-5-chlorobenzimidazole, 1-alkyl-5,6-dichloro-benzimidazole, 1-alkyl-5-methoxybenzimidazole, 1-alkyl-5-cyanobenzimidazole, 1-alkyl-5-fluorobenximidazole, 1-alkyl-5-trifluoromethylbenzimidazole, 1-alkylnaphtho[1,2-d]imidazole, 1-aryl-5,6-dichlorobenzimidazole, 1-aryl-5-chlorobenzimidazole, 1-arylimidazole, 1-arylbenzimidazole, 1-aryl-5-chlorobenzimidazole, 1-aryl-5-5-methoxybenzimidazole, 1-aryl-5-cyanobenzimidazole, 1-arylnaphtho[1,2-d]imidazole, wherein as alkyl substituents alkyl groups containing 1 to 8 carbon atoms therein, for example, unsubstituted alkyl groups such as methyl, ethyl, propyl, isopropyl, butyl, etc., and hydroxyalkyl groups such as 2-hydroxyalkyl, 3-hydroxypropyl, etc., are particularly preferred, and as aryl substituents phenyl substituted phenyl, halogen (e.g., chloro) substituted phenyl, alkyl (preferably an alkyl group with from 1 to 4 carbon atoms, e.g., methyl) substituted phenyl, alkoxy (preferably an alkoxy group with 1 to 4 carbon atoms, e.g., methoxy) substituted phenyl and the like are most preferred, pyridine nuclei (e.g., pyridine, 5-methyl-2-pyridine, 3-methyl-4-pyridine, etc.), oxadiazole nuclei, thiadiazole nuclei, tetrazole nuclei, pyrimidine nuclei and so on; X represents an inorganic or an organic acid anion such as chloride, bromide, iodide, p-toluene sulfonate, methane sulfonate, methyl sulphate, ethyl sulphate, perchlorate, etc.; R and $R_1$ each represents an alkyl group, for example, those which have 1 to 18, and preferably 1 to 7, carbon atoms (which term includes unsubstituted alkyl groups (e.g., methyl, ethyl, propyl, isopropyl, butyl, hexyl, dodecyl, octadecyl, etc.) and substituted alkyl groups, for example, aralkyl groups (e.g., benzyl, β-phenylethyl, etc.), hydroxyalkyl groups (e.g., 2-hydroxyethyl, 3-hydroxypropyl, etc.), carboxyalkyl groups (e.g., 2-carboxyethyl, 3-carboxypropyl, 4-carboxybutyl, etc.), alkyl groups substituted with one or more sulfo groups (e.g., 2-sulfoethyl, 3-sulfopropyl, 3-sulfobutyl, 4-sulfobutyl, 2-(3-sulfopropoxy)-ethyl, 2-hydroxy-3-sulfopropyl, 3-sulfopropoxyethoxyethyl, etc.), and sulphatoalkyl groups (e.g., 3-sulphatopropyl, 4-sulphatobutyl, etc.)) or an aryl group (for instance, a phenyl or naphthyl group which can be substituted with an alkyl group having 1 to 4 carbon atoms, an alkoxy group having 1 to 4 carbon atoms, halogen (e.g., Cl, Br), a sulfoalkyl group wherein the alkyl moiety has from 1 to 4 carbon atoms, a carboxyalkyl group wherein the alkyl moiety has from 1 to 4 carbon atoms, an aryl group (e.g., phenyl or naphthyl), etc., e.g., phenyl, tolyl, naphthyl, methoxyphenyl, chlorophenyl, etc.), wherein at least one of R, $R_1$, Z, $Z_1$ and L should contain at least one group selected from a class consisting of a carboxy group, a sulfo group, a sulphate group, and a phosphate group, and wherein, if desired, all of R, $R_1$, Z, $Z_1$ and L can contain such groups, and wherein q represents 1 when the dye forms a betaine-type structure.

It is known that the sulfo substituted cyanine dyes represented by the following general formula (VI'), which is included in the class of cyanine dyes having general formula (VI), provide a J-band sensitization effect when added to a silver halide emulsion, and therefore, these sulfo substituted cyanine dyes may be used to particular advantage in spectrally sensitizing silver halide emulsions employed in the present invention:

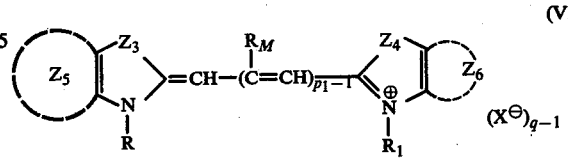

(VI')

wherein $Z_3$ and $Z_4$ each represents $$-O-,\ -\overset{|}{N}-R_O,\ -S-\ \text{or}\ -Se-$$

(wherein $R_0$ represents an alkyl group, most preferably, an alkyl group from 1 to 8 carbon atoms, or a substituted alkyl group, wherein the alkyl moiety has from 1 to 8 carbon atoms and typical substituents include a sulfo group, a carboxy group, a hydroxy group, and the like), $Z_5$ and $Z_6$ each represents an atomic group necessary to form a benzene or a naphthalene ring (which terms include benzene rings and naphthalene rings which are unsubstituted or substituted, for example, substituted with halogen (Cl, Br), an alkyl group with from 1 to 4 carbon atoms, an alkoxy group with from 1 to 4 carbon atoms, an aryl group (e.g., phenyl, naphthyl), an aryloxy group (e.g., phenoxy), a hydroxy group, an aralkyl group (e.g., benzyl) and the like), $R_M$ represents H, an alkyl group (preferably having from 1 to 4 carbon atoms, e.g., methyl, ethyl, etc), an aryl group (e.g., phenyl, naphthyl, etc.), or a substituted aryl group, most preferably an aryl group substituted with an alkyl group having from 1 to 4 carbon atoms, a sulfo group, a carboxy group, a hydroxy group, or the like, R and $R_1$ have the same meaning as in general formula (VI), respectively, wherein either R or $R_1$ should represent a sulfo group-containing alkyl group, most preferably where the alkyl moiety has from 1 to 8 carbon atoms, $p_1$ represents 1 or 2, and $X^-$ and q each has the same meaning as in general formula (VI).

Specific examples of spectral sensitizing dyes which may be used in the practice of the present invention are illustrated below; the present invention is not limited to the compounds specifically described below however.

Dye-1 bis[2-{3-(2-sulfoethyl)-5-phenylbenzoxazole}]-β-ethyltrimethinecyanine pyridine salt, Dye-2 bis-[2-{3-(3-sulfopropyl)-5-phenylbenzoxazole}]-β-ethyltrimethinecyanine, Dye-3 Anhydro[2-{3-(4-sulfobutyl)benzothiazole}][2-(3-ethylbenzothiazole)]-β-methyltrimethinecyanine hydroxide, Dye-4 bis-[2-{3-(4-sulfobutyl)benzothiazole}]-β-methyltrimethinecyanine pyridine salt, Dye-5 Anhydro[2-(1,6-diethylquinoline)][2-{3-(4-sulfobutyl)-5-methoxybenzoselenazole}]methinecyanine hydroxide, Dye-6 bis[2-{1-ethyl-3-(3-sulfopropyl)-5,6-dichlorobenzimidazole}] trimethinecyanine sodium salt, Dye-7 bis-[2-{3-(4-sulfobutyl)benzoselenazole}]-β-methyltrimethinecyanine pyridine salt, Dye-8 Anhydro[2-{3-(3-sulfobutyl)benzothiazole}][2-(3-ethylbenzothiazole]-β-methyltrimethinecyanine hydroxide, Dye-9 [2-{3-(3-sulfopropyl-5-phenylbenzoxazole}][2-{1-ethyl-3-(3-sulfopropyl)-5,6-dichlorobenzimidazole}]trimethinecyanine, Dye-10 bis-[2-{3-(3-sulfopropyl)-5-methylbenzoselenazole}]-β-methyl-trimethinecyanine, Dye-11 [2-{1-(3-sulfopropyl)-6-methylquinoline}][2-{3-(3-sulfopropyl)-5-methoxybenzoselenazole}]-methinecyanine, Dye-12 bis-[2-{3-(3-sulfopropyl)-5-chlorobenzothiazole}]-β-ethyltrimethinecyanine pyridine salt, Dye-13 bis-[2-{3-(3-sulfopropyl)naphto[1,2-d]thiazole}]-β-ethyl-trimethinecyanine triethylamine salt, Dye-14 [2-{3-(3-sulfopropyl)naphtho[1,2-d]thiazole}][2-{1-ethyl-(3-sulfopropyl)-5,6-dichlorobenzimidazole}] trimethinecyanine triethylamine salt, Dye-15 [2-{3-(3-sulfobutyl)-5-chlorobenzoxazole}][2-{1-ethyl-3-(3-sulfobutyl)-5,6-dichlorobenzimidazole}] trimethinecyanine sodium salt, Dye-16 [2-{3-(3-sulfopropyl)-5-chlorobenzothiazole}] [2-{3-(3-sulfopropyl)-5-chlorobenzoxazole}]-β-ethyltrimethinecyanine pyridine salt, Dye-17 Anhydro[2-{3-(3-sulfopropyl)-5-phenyl benzoxazole}] [2-(3-ethyl-5-chlorobenzoxazole)]-β-ethyltrimethinecyanine hydroxide, Dye-18 Anhydro[2-(3-ethyl-5-phenylbenzoxazole)][2-{1-ethyl-3-(3-sulfopropyl)-5,6-dichlorobenzimidazole}]trimethinecyanine hydroxide, Dye-19 Anhydro[2-(3-ethylbenzothiazole)][2-{3-(sulfoethyl)-5-phenylbenzoxazole}]-β-methyl-trimethinecyanine hydroxide, Dye-20 Anhydro[2-{1-(3-sulfopropyl)quinoline}][2-(1-methylquinoline)]methinecyanine hydroxide, Dye-21 [2-(3-ethylbenzoxazole)][2-{1-ethyl-3-(2-carboxyethyl)-5,6-dichlorobenzimidazole}]-trimethinecyanine bromide, Dye-22 {2-(3-ethylnaphtho[1,2-d]oxazole)}[2-{1-ethyl-3-(2-carboxyethyl)-5,6-dichlorobenzimidazole}]trimethinecyanine bromide, Dye-23 [Anhydro(2-(1-ethylquinoline)][2-{3-(3-sulfopropyl)-5-phenylbenzoxazole}]methinecyanine hydroxide, Dye-24 Anhydro[2-{3-(3-sulfopropyl)naphtho[1,2-d]thiazole}] [2-(3-ethyl-naphto[1,2-d]thiazole)}-β-phenyltrimethinecyanine hydroxide, Dye-25 bis-[2-{3-(3-sulfopropyl)-5-chlorobenzothiazole}] methinecyanine triethylamine salt, Dye-26 [2-{3-(2-sulfoxyethyl)benzothiazole}][2-(1-ethylquinoline)]methinecyanine bromide, Dye-27 Anhydro[2-{3-(2-sulfoxyethyl)-5-methoxybenzoselenazole}] [2-(1-ethylquinoline)]methinecyanine hydroxide, Dye-28 [2-{3-(2-hydroxyethyl)-5-methylbenzothiazole}][2-{3-(3-sulfoxybutyl)-5-methylbenzothiazole}]-β-ethyltrimethinecyanine, Dye-29 [2-{3-(3-sulfopropyl)-5-carboxybenzothiazole}][2-{3-(3-sulfopropyl)-5-hydroxybenzothiazole}]-β-ethyl-trimethinecyanine, Dye-30 bis-[2-{3-(3-sulfopropyl)naphto[1,2-d]thiazole}]-β-(2-carboxyphenyl)-trimethinecyanine sodium salt, Dye-31 bis-[2-{3-methyl-5-(4-sulfophenyl)-benzoxazole}]-β-ethyltrimethinecyanine, Dye-32 bis-[2-(3-sulfoallylbenzothiazole)]trimethinecyanine triethylamine salt, and Dye-33 bis-[2-(3-ethylbenzothiazole)]-β-(3-sulfopropoxy) trimethinecyanine.

The term "water soluble solution of a dye" used in the present specification and claims includes a mixed aqueous solution containing a small amount (e.g., about 20 volume percent or less) of a water-miscible organic solvent such as an alcohol, an ether, a ketone, (e.g., methanol, ethanol, methyl Cellosolve, acetone, etc.) in addition to a conventional, simple water solution.

It should be understood that satisfactory solubility of a dye can be obtained by making a water solution according to the formulation of the present invention without adding any water-miscible organic solvents thereto.

The combination of a dye or dyes used in the present invention, which is substituted with at least one group selected from the class consisting of a carboxy group, a sulfo group, a sulphate group and a phosphate group, and the "Red Shift Compound" may be employed in a wide variety of concentrations of the latter which have the function of increasing the solubility of the dye or dyes in water.

The amount of the methine dye(s) employed in the practice of the present invention is the amount commonly adopted in the art of making photographic light-sensitive materials, and conveniently the amount of each methine dye is in the concentration range of about $1 \times 10^{-6}$ to about $1 \times 10^{-3}$ mole per mole of silver halide in the emulsion. When in the solution, the methine dye(s) is/are preferably present in an amount from about $10^{-4}$ to about $10^{-1}$ mol/l, preferably from $5 \times 10^{-4}$ to $5 \times 10^{-3}$ mol/l.

"Red Shift Compounds" having a solubility in water of more than about 0.005 weight %, preferably more than 0.1 weight %, are used to advantage in increasing the solubility of the dye(s) in water. The preferred addition amount of the "Red Shift Compound(s)" is not limited to any specified range, but the amount of the "Red Shift Compound(s)" in the aqueous solution advantageously ranges in concentration from about 0.005 to about 2 weight %, preferably from 0.005 to 0.5 weight %, and particularly preferably from 0.005 to 0.2 weight % based on solution weight. When more than one "Red Shift Compound" is used, the total amount of the "Red Shift Compounds" is within the above range. As advantageous molar ratio of the amount of the methine dye(s) to that of the "Red Shift Compound(s)" (methine dye(s)/"Red Shift Compound(s)") ranges from about 1/1 to about ½. As noted hereinbefore, the "Red Shift Compounds" employed in the practice of the present invention are those which essentially shift the maximum absorption wavelength of the dye prepared by the dye(s) being dissolved in a methanol-water mixed solvent (the volume ratio of methanol to water being 1:4, hereinafter called A-solution) toward the longer wavelength side.

The decision as to whether a given compound is a "Red Shift Compound" or not can be made based upon the following simple test. One solution is prepared by dissolving the desired dye in A-solution and another solution is prepared by dissolving a mixture of the dye and a given compound to be tested in a methanol-water mixed solvent identical to the above A-solution (hereinafter called B-solution). The spectral absorption values of the A-solution and a B-solution are each measured by a spectrophotometer. When the maximum absorption wavelength of the B-solution is at a longer wavelength than that of the A-solution, the given compound is a "Red Shift Compound".

"Red Shift Compounds" will be illustrated in detail by reference to the following examples.

The following dye solutions were prepared; (a) Dye-3 was dissolved in a mixed solvent (the volume ratio of methanol to water equals 1:4). A spectral absorption measurement was made on the solution at a concentration of $7.5 \times 10^{-6}$ mole/liter of Dye-3. (b) Dye-3 and a given compound to be tested were dissolved at a molar ratio of the former to the latter of 1:2 in the same mixed solvent as used in above (a). The concentration of the dye in the solution employed for the spectral absorption measurement was $7.5 \times 10^{-6}$ mole/liter. A solution of the given compound prepared by dissolving the given compound in the same mixture solvent as in (a) at a concentration of $1.5 \times 10^{-5}$ mole/liter was used as a reference. Compound 20 and compound A (employed for comparison) having the following formula $$C_{17}H_{33}CON(CH_3)-(CH_2)_2SO_3Na,$$

were tested.

Spectral absorption measurements were made on these solutions using a Hitachi EPS-3T type spectrophotometer. The results were shown in FIG. 1, where Curve 1 shows the absorption spectrum of the solution of Dye 3 in the above solvent, Curve 2 shows the absorption spectrum the solution of Dye 3 and compound A in the solvent and Curve 3 shows the absorption spectrum of the solution of Dye 3 and compound 20 in the solvent.

Since the maximum absorption wavelengths were about 552 nm in Curve 3 and 542 nm in Curve 1, the maximum absorption wavelength of Curve 3 was longer by about 10 nm than that of Curve 1. Therefore, compound 20 having water solubilizing capability is a "Red Shift Compound".

The maximum abosorption wavelength of Curve 2 was almost the same as that of Curve 1, so compound A does not fall in the category of a "Red Shift Compound". According to the above-described test, it can be determined whether a given compound is a "Red Shift Compound" or not.

In addition, the same result as in Curve 2 was obtained when 2,6-naphthalene disulfonic acid was employed instead of the above-described compound A.

In accordance with one embodiment of the present invention, the solubility of methine dyes in water can be remarkably increased due to the presence of a water soluble "Red Shift Compound". Many methine dyes are water-insoluble, and even if they are dissolved in water, the solutions are unstable with the passage of time and easily separate out precipitates thereof and the solution deteriorates.

The methine dyes containing one or more water soluble group (e.g., carboxy, sulfo, sulphate, phosphate), particularly one or more sulfo groups, which have excellent photographic characteristics, seem to be water-soluble at a glance from a chemical structural point of view, but many of them are only slightly soluble in water per se. In addition, methine dyes soluble in water to a certain extent are also apt to have an aggregation band such as a J-band or H-band as a water solution thereof, and are easily separated out from the water solutions thereof on storage.

Methods of rendering such dyes slightly soluble in water more water-soluble or increasing the solubilities of the dyes in water are known. For example, the introduction of anionic surface active agents into water solutions containing such dyes can render such dyes water-soluble, and making the leuco compounds of dyes only slightly soluble in water by adding an aqueous solution of sulfonic acid, which is a strong acid, can render such dyes water-soluble. However, both methods described above can only be applied to limited methine dyes having special chemical structures, or the above-described conventional methods cannot often provide dyes of adequate solubility in water.

On the other hand, it was found in the present invention that water-soluble "Red Shift Compounds" increase the solubility of water-soluble group-containing methine dyes in water. It can be assumed that the formation of a complex of a methine dye with a water-soluble "Red Shift Compound" probably contributes to the stabilization of the methine dye in water solution, and, therefore, the increase in solubility of the dye in the water solution used in the present invention. The solubility-increasing function described above differs from the solubilization of a dye in an aqueous solution containing an anionic surface active agent over the CMC concentration. Namely, in the mechanism of the solubilization an anionic active agent is necessary in an amount providing a concentration over the CMC concentration, regardless of the amount of a dye to be dissolved. In the method employed in the present invention, a "Red Shift Compound" sufficiently increases solubility when used in an amount at least equimolar, preferably more than equimolar, concentration to that of the dye, and so an extremely small amount of a "Red Shift Compound" is enough when the amount of methine dye to be dissolved is very small.

In the method of the present invention, "Red Shift Compounds" have the effect of increasing solubility to a certain extent even when used in an amount less than equimolar concentration to that of a methine dye, but it is preferred to use them at least an equimolar concentration based on that of the methine dye(s).

In one embodiment of the present invention, a methine dye is dissolved in an aqueous solution of a "Red Shift Compound" or water can be added to the methine dye(s) and the "Red Shift Compound(s)" or both the methine dye(s) and the "Red Shift Compound(s)" can simultaneously be added to water to dissolve the methine dye(s) in water.

Moreover, anionic surface active agents can be added to aqueous solutions of methine dyes which can employed in the practice of the present invention. In addition, it is also possible to use aqueous solutions of methine dyes in the present invention which can be prepared according to conventional techniques available to the art. Further, organic solvents (e.g., methanol, ethanol, methyl Cellosolve, acetone, etc.) can be added, preferably in a comparatively small amount, to an aqueous solution containing both a methine dye and a "Red Shift Compound" in order to prepare an aqueous solution of the dye in high concentration.

Further, aqueous solutions containing both methine dyes and "Red Shift Compounds" can be dispersed into hydrophilic colloids (e.g., gelatin, polyvinyl alcohol, or other colloids (or dispersing agents) as disclosed in U.S. Pat. No. 3,039,873; Column 13).

While one "Red Shift Compound" exhibits a satisfactory effect in the present invention, the combined use of not less than two kinds thereof can produce much better results.

When spectral sensitization is carried out by the use of an aqueous solution containing both a methine dye and a "Red Shift Compound" not only are no difficulties encountered in the high-speed coating of photographic emulsions, for example, lowering in the surface active ability of a coating aid in the photographic emulsion which is caused by the addition of a large amount of an organic solvent, thereto, precipitation of couplers, or the like, avoided, but also improvements in photographic characteristics such as a reduction in fog, an increase in spectral sensitization efficiency, etc., are attained.

The time of addition to a silver halide emulsion of the aqueous solutions of sensitizing dyes which may be employed in the present invention is not particularly limited to any specified time. In the case of silver halide emulsions which are chemically ripened, it is convenient, in general, to add the dye solution(s) after the conclusion of chemical ripening, but they may be added in any process before the conclusion of chemical ripening. (for example, in the course of chemical ripening or after physical ripening).

The light-sensitive components to which the method of the present invention can be applied are not limited and include, for example, silver halide, titanium oxide, zinc oxide, cadmium sulfide, organic compound-silver complexes, organic macromolecular photo-conductors, and the like. When materials other than silver halides are used, the same ranges of methine dye(s) and Red Shift Compound(s) as earlier described for the silver halide apply, for example, conveniently the amount of methine dye is in the concentration range of about $1 \times 10^{-6}$ to about $1 \times 10^{-3}$ mol per mol of the other materials, with other earlier set forth ranges applying merely by substituting the material involved for the terminology "silver halide" in the earlier discussion.

The light-sensitive components may be dispersed into a binder such as a hydrophilic colloid, e.g., gelatin or the like, and may also be applied to a support without using a binder (for example, silver halide may be evaporated in a thin film onto a support under vacuum.). In the latter case, the aqueous solution prepared in the present invention is applied to the layer of the light-sensitive component to result in spectral sensitization. For example, application can be by simple immersion in a solution of the materials.

The silver halides employed as light-sensitive components are conventional and include silver chloride, silver bromide, silver chlorobromide, silver iodobromide and silver iodochlorobromide. In addition, silver iodide or silver iodochloride may also be employed, as can mixtures.

The silver halide photographic emulsions to which the present invention can be applied can be produced in a conventional manner, for example, by a single jet method, a double jet method or a combination of such methods. Preparation methods of silver halide emulsions are described in, for example, "The Photographic Journal", by Trivelli & Smith, vol. 79, p. 330~338, (1939); "The Theory of the Photographic Processes", by C.E.K. Mees, Macmillan Publishers; and "Photographic Chemistry", by Glafkides, vol. 1, p. 327~336, Fountain Press.

The silver halide particles in photographic emulsions to which the present invention can be applied may have a conventionally used grain size or may be finely divided, and a preferred mean grain diameter (measured by, e.g., a projected area method or a number average method) is from about 0.04 micron to about 4 microns.

Light-sensitive emulsions which have not received chemical ripening treatment may be conventionally chemically sensitized. Techniques such as gold sensitization (as disclosed in U.S. Pat. Nos. 2,540,085; 2,597,876; 2,597,915; 2,399,083; etc.), sensitization with a Group VIII metal ion, sulfur sensitization (as disclosed in U.S. Pat. Nos. 1,574,944; 2,278,947; 2,440,206; 2,410,689; 3,189,458; 3,415,649; etc.) reduction sensitization (as disclosed in U.S. Pat. Nos. 2,518,698; 2,419,974; 2,983,610; etc.), or a combination of these sensitization techniques can be used.

More specifically, the emulsion can contain as chemical sensitizers a sulfur sensitizer such as allylthiocarbamide, thiourea, sodium thiosulfate or cystine; a noble metal sensitizer such as potassium chloroaurate, aurous thiosulfate, or potassium chloropalladate; a reduction sensitizer such as tin chloride, phenylhydrazine or reductone; and the like. Also, the emulsion can contain a sensitizer such as a polyoxyethylene derivative (as disclosed in British Pat. No. 981,470; Japanese Patent Publication No. 6475/56; U.S. Pat. No. 2,716,062; etc.), a polyoxypropylene derivative, a quaternary ammonium groupcontaining derivative or the like.

The light-sensitive emulsions to which the method of the present invention can be applied may contain an antifogging agent and a stabilizing agent. As examples thereof, mention can be made of thiazolium salts as disclosed in U.S. Pat. Nos. 2,131,038 and 2,694,716; azaindenes as disclosed in U.S. Pat. Nos. 2,886,437 and 2,444,605; urazoles as disclosed in U.S. Pat. No. 3,287,135; sulfocatechols as disclosed in U.S. Pat. No. 3,236,652; oximes as disclosed in British Pat. No. 623,448; mercaptotetrazoles as disclosed in U.S. Pat. Nos. 2,403,927; 3,266,897; 3,397,987; etc.: nitrone; nitroindazoles; polyvalent metal salts as disclosed in U.S. Pat. No. 2,839,405; etc.: thiuronium slats as disclosed in U.S. Pat. No. 3,220,839; etc.: salts of palladium, platinum and gold as disclosed in U.S. Pat. Nos. 2,566,263; 2,597,915; etc.: and so on.

The silver halide photographic emulsions to which the method of the present invention can be applied can contain a developing agent (e.g., hydroquinones, catechols, aminophenols, 3-pyrazolidones, ascorbic acid and derivatives thereof, reductones, phenylenediamines, or the like), or a combination of these developing agents. The developing agent may be used in the form of a solution prepared by dissolving it in an appropriate solvent or in the form of a dispersion as disclosed in U.S. Pat. No. 2,593,368 and French Pat. No. 1,505,778.

A coating aid can be added to light-sensitive emulsions to which the method of the present invention can be applied, such as saponin, salts of alkylarylsulfonic acids as disclosed in U.S. Pat. No. 2,600,831; etc.: amphoteric compounds as disclosed in U.S. Pat. No. 3,133,816; etc.: or the like.

The light-sensitive emulsion which may be employed in the present invention can contain conventional additives such as an antistatic agent, a plasticizer, a fluorescent whitenessincreasing agent, a development-accelerating agent, an agent for preventing an emulsion from being fogged on exposure to air, a color-toning agent and the like.

Moreover, the silver halide photographic emulsion to which the method of the present invention can be applied can contain, depending on the end use, color couplers as disclosed in, for example, U.S. Pat. Nos. 3,311,476; 3,006,759; 3,277,155; 3,214,437; 3,253,924; 2,600,788; 2,801,171; 3,252,924; 2,698,794 and 2,473,293; British Pat. No. 1,140,898; and so on.

In addition, a development inhibitor-releasing type coupler (DIR coupler) or a development inhibitor-releasing compound can be added to the emulsion, if desired. Examples of such are described in U.S. Pat. Nos. 3,148,062; 3,227,554; 3,253,924; 3,617,291; 3,622,328 and 3,705,201; British Pat. No. 1,201,110; U.S. Pat. Nos. 3,297,445; 3,379,529 and 3,639,417; and so on.

The above-described couplers or the like can be added as a combination of two or more kinds thereof to only one layer, or only one kind of such compounds can be added to two or more layers simultaneously.

The above-described couplers include couplers containing water soluble groups such as carboxy, hydroxy, sulfo, or like groups and hydrophobic couplers. They are added to the emulsions by conventional techniques for the addition or dispersion of couplers. Hydrophobic couplers may be dispersed into emulsions by various methods, e.g.:

(a) dispersing the couplers which have previously been mixed with an organic solvent having a high boiling point such as phthalic acid esters, trimellitic acid esters, phosphoric acid esters, liquid fatty oils and liquid waxes at ordinary temperatures, etc., with the aid of an anionic surface active agent, as disclosed in, for example, U.S. Pat. Nos. 2,304,939; 2,322,027; etc., (b) dispersing the couplers by mixing them with an organic solvent having a low boiling point or with a water-soluble organic solvent, as disclosed in U.S. Patents 2,801,170; 2,801,171; 2,949,360; etc., (c) dispersing the couplers alone or together with other couplers, such as colored couplers, DIR-couplers or the like, the combined use of which will produce good results when the couplers themselves have a sufficiently low melting point (preferably lower than 75° C.), as disclosed in, for example, German Pat. No. 1,143,707, and so on. Water-soluble couplers may be used in the form of an alkaline solution, or may be used in combination with hydrophobic couplers and a dispersing aid for hydrophobic couplers (e.g., an anionic surface active agent).

Further, photographic emulsions spectrally sensitized by the method of the present invention can optionally contain dyes employed for anti-irradiation effects. For example, compounds as disclosed in Japanese Patent Publications Nos. 20389/66, 3504/68 and 13168/68; U.S. Pat. Nos. 2,697,037; 3,423,207 and 2,865,752; British Pat. Nos. 1,030,392 and 1,100,546; and so on can be employed.

When a silver halide is used as the light-sensitive component in the practice of the present invention, gelatin silver halide emulsions will generally be used. However, certain materials which do not harm light-sensitive silver halides, such as albumin, agar-agar, gum arabic, alginic acid, acylated gelatins (e.g., phthalated gelatin, malonated gelatin, etc.), hydrophilic polymers (e.g., polyvinyl alcohol, polyvinyl pyrrolidone, polyacrylamide, polystyrene sulfonic acid, etc.), cellulose derivatives (e.g., hydroxyethyl cellulose, carboxymethyl cellulose, dextrin, etc.) and water-soluble starchs may be employed instead of gelatin or in combination.

A light-sensitive emulsion prepared in accordance with the present invention can be employed for making various kinds of light-sensitive materials. Namely, it may be used to produce not only emulsions for monochromatic sensitive materials, but also light-sensitive emulsions for positive type color films, colored papers, negative type color films, reversal color films (wherein a coupler may be present in the emulsion or not), photographic light-sensitive materials for plate making (e.g., lithographic films, etc.), light-sensitive materials for cathode ray tube displays, light-sensitive materials for X-ray recording (particularly materials for direct and indirect radiography using fluorescent screens), high resolution sensitive materials, colloid transfer processes (as disclosed in, for example, U.S. Pat. No. 2,716,059), silver salt diffusion transfer processes (as disclosed in, for example, U.S. Pat. Nos. 2,352,014; 2,543,181; 3,020,155; 2,861,885; etc.), color diffusion transfer processes (as disclosed in, for example, U.S. Pat. Nos. 3,087,817; 3,185,567; 2,983,606; 3,253,915; 3,227,550; 3,227,551; 3,227,552; 3,415,644; 3,415,645; 3,415,646; etc.), imbibition transfer processes (as disclosed in, for example, U.S. Pat. No. 2,882,156; etc.), silver dye bleaching processes (as discribed in "History of Color Photography" by Friedman, American Photographic Publishers Co., 1944, particularly in Chapter 24; and British Journal of Photography, vol. 111, p. 308~309, Apr. 7, 1964; etc.), printout image recording materials (as disclosed in, for example, U.S. Pat. Nos. 2,369,449; Belgium Pat. No. 704,255; etc.), light developable type print-out light-sensitive materials (as disclosed in, for example, U.S. Pat. Nos. 3,033,682; 3,287,137; etc.), heat developable light-sensitive materials (as disclosed in, for example, U.S. Pat. Nos. 3,152,904; 3,312,550 and 3,148,122; British Pat. Nos. 1,110,046; etc.), light-sensitive materials for physical development (as disclosed in, for example, British Pat. Nos. 920,277; 1,131,238; etc.), direct positive films (as disclosed in, for example, U.S. Pat. Nos. 2,497,875; 2,541,472; 3,367,778; 3,501,309; 3,501,310; 3,505,070; 3,531,290; 3,501,305; 3,501,306; 3,501,307; 3,501,312 and 3,510,348; British Pat. Nos. 1,186,711; 1,186,712 and 1,186,713; etc.), and so on.

Simultaneous use of the spectral sensitization technique in accordance with the present invention and conventional sensitization techniques, e.g., as disclosed in Japanese Patent Application No. 128,755/73, commonly employed supersensitization techniques or supersensitization techniques in accordance with the method described in Japanese Patent Application No. 127,521/73 is permissible. Spectral sensitizing dyes and supersensitizing agents are used in amounts conventionally employed in supersensitization. Such amounts can easily be determined by using the common knowledge and experience of one skilled in the art. Specifically, several to several ten, in some cases several hundred, times as much supersensitizing agent as dye used (weight ratio) can be employed. In the case that the combined use of two kinds of spectral sensitizing dyes shows a supersensitization action, the molar ratio of the amounts of the dyes capable of showing supersensitization ranges from about 1:10 to about 10 to 1.

The present invention will now be illustrated in greater detail by reference to the following examples which, however, are not intended to limit the present invention in any way.

Unless otherwise indicated, in the examples all percentages, parts, and the like were by weight and all processings were conducted at room temperature.

EXAMPLE 1

This example shows that the dissolution method of the present invention is excellent.

A dye and a "Red Shift Compound" were dissolved simultaneously in distilled water, the molar ratio of the former to the latter being 1:2.

Concentrations at which given dyes were tried to be dissolved in water in the presence of a "Red Shift Compound", and the results, are shown in Table 1. For purposes of comparison, the dissolution properties in distilled water and in methanol are also shown therein.

Table 1

| Solvent | Dye 3 | Dye 5 | Dye 9 | Dye 10 |
|---|---|---|---|---|
| Water solution of Compound-20 | $4 \times 10^{-3}$ mol/l soluble | $4 \times 10^{-3}$ mol/l soluble | $4 \times 10^{-3}$ mol/l soluble | $4 \times 10^{-3}$ mol/l soluble |
| Distilled water | $5 \times 10^{-5}$ mol/l insoluble | $5 \times 10^{-5}$ mol/l insoluble | $2 \times 10^{-3}$ mol/l insoluble | $1 \times 10^{-3}$ mol/l insoluble |
| Methanol | $5 \times 10^{-4}$ mol/l insoluble | $1 \times 10^{-3}$ mol/l insoluble | $2 \times 10^{3}$ mol/l soluble* | $2 \times 10^{-3}$ mol/l insoluble |

*Precipitates of the dye separated out after five days

As can be seen from the above table, an aqueous solution of each of the dyes examined above, that is, Dye 3, Dye 5, Dye 9 and Dye 10, could be prepared in a concentration of as high as $4 \times 10^{-3}$ mol/l. On the other hand, each of these dyes could be dissolved in a water solution of the dye alone only in lower concentrations. Moreover, the dissolution method of the present invention is also characterized by the attainment of higher concentrations than those obtained in a methanol solution.

EXAMPLE 2

A silver iodobromide-gelatin emulsion (AgI : AgBr = 7 mol %: 93 mol %; Gelatin (solid)/$AgNO_3$ = 0.54 (weight ratio) 0.52 mole of silver salt per Kg of emulsion) was spectrally sensitized by the use of a solution of Dye 12 prepared by the method hereinafter described.

Dye 12 was dissolved in a water solution containing a "Red Shift Compound" at a concentration of $1 \times 10^{-3}$ mol/l and a concentration of $5 \times 10^{-4}$ mol/l, respectively, to prepare a dye solution. The "Red Shift Compounds" employed are listed in Table 2. For purposes of comparison, a water solution of the dye having a dye concentration of $5 \times 10^{-4}$ mol/l was prepared by dissolving the dye in water at 60° C. For purposes of further comparison, a methanol solution of the dye having a dye concentration of $5 \times 10^{-4}$ mol/l was also prepared. The above-described solutions were each added to the emulsion in an amount of 150 ml per Kg emulsion in order to spectrally sensitize the emulsion. Each of these sensitized spectrally emulsions was coated on a cellulose triacetate film base to provide a dry thickness of 5μ, and then dried.

The resulting film samples were wedge-wise exposed for 1/50 second using a daylight source of 64 Lux (corresponding to a color temperature of 5400° K.) covered by a Wratten filter No. 16 (a yellow filter for the measurement of minus blue sensitivity). The thus exposed samples were development-processed at 20° C. for 6 minutes using a developing solution having the following composition. Density measurements were then carried out using a P-type densitometer (made by Fuji Photo Film Co., Ltd.), whereby minus blue sensitivity and fog values were obtained. The standard point of optical density to determine sensitivity was fog + 0.1. The results obtained are shown in Table 2 as the relative values.

| Composition of the Developing Solution | |
|---|---|
| Metol | 2 g |
| Sodium Sulfite (anhydrous) | 40 g |
| Hydroquinone | 4 g |
| Sodium Carbonate (monohydrate) | 28 g |
| Potassium Bromide | 1 g |
| Water to make | 1 l |

Table 2

| Solvent | Sensitivity | Fog | Red Shift Value* (nm) |
|---|---|---|---|
| Aqueous Solution of Compound 1 | 117 | 0.10 | 3 |
| Aqueous Solution of Compound 17 | 110 | 0.10 | 3 |
| Water | 95.5 | 0.11 | — |
| Methanol | 100 | 0.10 | — |

*Determined in accordance with the test described to judge whether certain compounds are "Red Shift Compounds" or not.

As can be seen from the above table, the films obtained in accordance with the present invention had high sensitivity.

A similar increase in sensitivity was obtained even when $TiO_2$ or ZnO was employed as a light-sensitive element instead of silver halide or where a hydrophilic colloid such as cellulose phthalate, polyvinyl alcohol, polyacrylamide containing acrylic amide monomer units in an amount of 30~60 wt % or a mixture thereof was employed instead of gelatin.

Dye 12 could only be slightly dissolved in the aqueous solution of Compound A employed for comparison, and, therefore, a dye solution could not obtained in this case. The addition of the dye to an emulsion was also impossible. In addition, Dye 12 condensed in the water solution of the dye alone at room temperature to separate out as a precipitate, and, therefore, a solution of this kind cannot employed.

EXAMPLE 3

This example further establishes that the dissolution method of the present invention is excellent.

Various dyes as shown in Table 3 each was added to a water solution of a certain "Red Shift Compound" as shown in Table 3 to result in solubilization. The molar ratio of the amount of the "Red Shift Compound" to that of the dye was adjusted to 2:1. The concentrations of the dissolved dyes and the dissolution properties were as shown in Table 3.

Table 3

| Dye | | Dissolution in aqueous solution of Compound 20 | Dissolution in distilled water |
|---|---|---|---|
| Sulfo group-containing dye | Dye 1 | $1 \times 10^{-3}$ mol/l soluble | $1.25 \times 10^{-4}$ mol/l soluble |
| | Dye 2 | $4 \times 10^{-3}$ mol/l soluble | $5 \times 10^{-4}$ mol/l soluble |
| | Dye 8 | $4 \times 10^{-3}$ mol/l soluble | $5 \times 10^{-5}$ mol/l insoluble |
| Carboxy group-containing dye | Dye 21 | $1 \times 10^{-3}$ mol/l soluble | $1 \times 10^{-5}$ mol/l insoluble |
| | Dye 22 | $1 \times 10^{-3}$ mol/l soluble | $1 \times 10^{-5}$ mol/l insoluble |

For purposes of comparison, dyes not containing any sulfo, carboxy, sulfate or phosphate group were tried to be dissolve. These dyes could not be dissolved in distilled water alone in concentrations of more than $5 \times 10^{-5}$ mole/liter. The solubility of these dyes not containing any water-soluble group in a water solution of a "Red Shift Compound" was low as compared with that in water alone.

As is apparent from above results, the dissolution method employed in the present invention was found to be particularly effective for sulfo group-containing dyes.

While the invention has been described in detail and with reference to specific embodiments thereof, it will be apparent to one skilled in the art that various changes and modifications can be made therein without departing from the spirit and scope thereof.

What is claimed is:

1. A method of spectrally sensitizing a photographic light-sensitive emulsion which comprises adding thereto an aqueous solution of a sulfo-substituted cyanine dye represented by the following general formula (VI')

(VI')

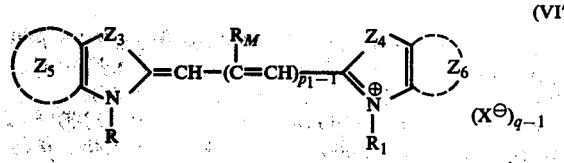

wherein $Z_3$ and $Z_4$ each represents $$-O-,\ -\overset{|}{N}-R_0,\ -S-\ \text{or}\ -Se-,$$

wherein $R_0$ represents an alkyl group or a substituted alkyl group; $Z_5$ and $Z_6$ each represents an atomic group necessary to form a benzene ring or a naphthalene ring; $R_M$ represents a hydrogen atom, an alkyl group, an aryl group, or a substituted aryl group; R and $R_1$ each represents an alkyl group or an aryl group, with either R or $R_1$ representing a sulfo group-containing alkyl group; $p_1$ represents 1 or 2; q represents 1 or 2; X represents an inorganic acid anion or an organic acid anion; and a Red Shift Compound represented by the following general formula (V)

(V)

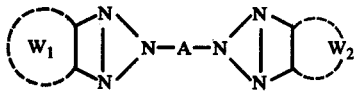

wherein —A— is a divalent aromatic residue, and $W_1$ and $W_2$ each represents an atomic group necessary to form a benzene ring or a naphthalene ring, where the benzene ring or naphthalene ring is substituted with one or more groups including at least one sulfo group, where the molar ratio of the amount of said sulfo-substituted cyanine dye represented by the general formula (VI') to the amount of said Red Shift Compound represented by the general formula (V) ranges from about 1:1 to about 1:2.

2. The method of claim 1, wherein said Red Shift Compound is selected from the group consisting of

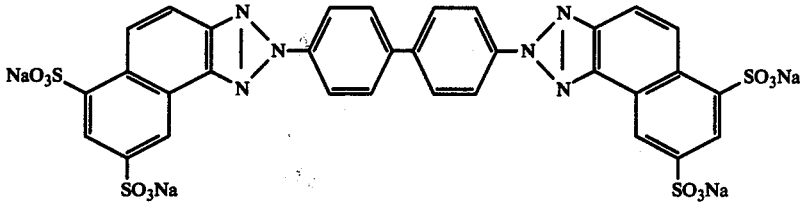

and

-continued

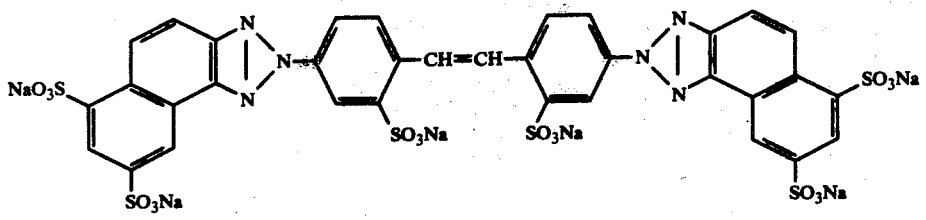

3. The method of claim 1, wherein the aqueous solution contains said Red Shift Compound at a concentration of about 0.005% to about 0.2% by weight.

4. A photographic light-sensitive material comprising at least one silver halide photographic emulsion layer on a support wherein at least one silver halide photographic emulsion layer is spectrally sensitized in accordance with the method of claim 1.

5. A multi-layered color photographic light-sensitive material comprising at least a support, a blue-sensitive silver halide emulsion layer coated on the support, a green-sensitive silver halide emulsion layer and a red-sensitive silver halide emulsion layer, characterized in that at least one of said silver halide emulsion layers is spectrally sensitized in accordance with the method of claim 1.

6. The method of claim 1, wherein said Red Shift Compound meets the following criterion: it shifts the maximum absorption wavelength of said sulfo-substituted cyanine dye if said sulfo-substituted cyanine dye is dissolved in a methanol-water mixed solvent, the volume ratio of methanol to water being 1:4, toward the longer wavelength side.

7. The method of claim 6, wherein said maximum absorption wavelength is shifted at least 1 mμ longer.

8. The method of claim 6, wherein said maximum absorption wavelength is shifted at least 2 mμ longer.

9. The method of claim 1, wherein the amount of the Red Shift Compound in the aqueous solution ranges in concentration from about 0.005 to about 2 wt. %.

10. The method of claim 9, wherein said sulfo-substituted cyanine dye is present in aqueous solution in an amount of from about $10^{-4}$ to about $10^{-1}$ mol/l.

11. The method of claim 1, wherein said Red Shift Compound is water-soluble.

12. The method of claim 1, wherein at least two kinds of Red Shift Compounds are used in combination.

* * * * *